US010232442B2

(12) United States Patent
Yang et al.

(10) Patent No.: US 10,232,442 B2
(45) Date of Patent: Mar. 19, 2019

(54) METHOD OF MAKING MACHINE COMPONENT WITH ALUMINUM ALLOY UNDER TEMPERATURE-LIMITED FORMING CONDITIONS

(71) Applicant: Caterpillar Inc., Peoria, IL (US)

(72) Inventors: Nan Yang, Brimfield, IL (US); Jeff A. Jensen, Dunlap, IL (US); Yajun Fan, Savoy, IL (US)

(73) Assignee: Caterpillar Inc., Deerfield, IL (US)

( * ) Notice: Subject to any disclaimer, the term of this patent is extended or adjusted under 35 U.S.C. 154(b) by 430 days.

(21) Appl. No.: 15/212,063

(22) Filed: Jul. 15, 2016

(65) Prior Publication Data

US 2018/0015545 A1 Jan. 18, 2018

(51) Int. Cl.

| | |
|---|---|
| ***B22F 3/20*** | (2006.01) |
| ***B22F 9/10*** | (2006.01) |
| ***B22F 9/04*** | (2006.01) |
| ***B22F 3/24*** | (2006.01) |
| ***C22C 21/08*** | (2006.01) |
| ***C22C 21/02*** | (2006.01) |
| ***C22C 21/00*** | (2006.01) |
| ***C22F 1/047*** | (2006.01) |
| ***C22F 1/043*** | (2006.01) |
| ***C22F 1/04*** | (2006.01) |
| ***B21C 29/00*** | (2006.01) |
| ***F04D 29/28*** | (2006.01) |
| ***F04D 29/02*** | (2006.01) |
| ***C22C 32/00*** | (2006.01) |
| ***C22C 33/00*** | (2006.01) |
| ***C22C 33/04*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *B21C 23/00* | (2006.01) |
| *B22F 5/00* | (2006.01) |

(52) U.S. Cl.

CPC ..... *B22F 3/20* (2013.01); *B21C 29/003* (2013.01); *B22F 3/24* (2013.01); *B22F 9/04* (2013.01); *B22F 9/10* (2013.01); *C22C 21/00* (2013.01); *C22C 21/02* (2013.01); *C22C 21/08* (2013.01); *C22C 32/0026* (2013.01); *C22C 33/00* (2013.01); *C22C 33/04* (2013.01); *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C22C 38/44* (2013.01); *C22C 38/46* (2013.01); *C22C 38/48* (2013.01); *C22C 38/50* (2013.01); *C22F 1/04* (2013.01); *C22F 1/043* (2013.01); *C22F 1/047* (2013.01); *F04D 29/023* (2013.01); *F04D 29/284* (2013.01); *B21C 23/002* (2013.01); *B22F 2003/208* (2013.01); *B22F 2003/247* (2013.01); *B22F 2003/248* (2013.01); *B22F 2005/005* (2013.01); *B22F 2009/046* (2013.01); *B22F 2202/07* (2013.01); *B22F 2302/45* (2013.01); *B22F 2998/10* (2013.01); *F05D 2230/10* (2013.01); *F05D 2230/24* (2013.01); *F05D 2230/40* (2013.01); *F05D 2300/173* (2013.01)

(58) Field of Classification Search

CPC ..... B22F 3/20; B22F 3/24; B22F 9/04; B21C 29/003; C22C 21/00; C22C 21/02; C22C 21/08; C22C 33/00

USPC ..... 419/28

See application file for complete search history.

(56) References Cited

U.S. PATENT DOCUMENTS

| | | | |
|---|---|---|---|
| 5,826,456 | A | 10/1998 | Kawazoe et al. |
| 8,323,428 | B2 | 12/2012 | Chipko et al. |
| 8,999,079 | B2 | 4/2015 | Kamat et al. |
| 2007/0084527 | A1 | 4/2007 | Ferrasse et al. |
| 2015/0283607 | A1 | 10/2015 | Yang et al. |

FOREIGN PATENT DOCUMENTS

| | | | |
|---|---|---|---|
| CN | 103758588 | A | 4/2014 |
| JP | S5770253 | | 4/1982 |
| JP | H06322467 | | 11/1994 |
| JP | 2009-263720 | A | 11/2009 |
| JP | 2011122180 | | 6/2011 |
| WO | WO 2012/169317 | A1 | 12/2012 |

*Primary Examiner* — Edward M Johnson

(74) *Attorney, Agent, or Firm* — Leydig, Voit & Mayer, Ltd.

(57) ABSTRACT

A method of making a machine component includes extruding a supply of an aluminum alloy to produce an extrusion. The extrusion is formed under temperature-limited forming conditions of 275° C. or less to produce a blank. The blank is machined to at least one predetermined tolerance to produce the machine component.

20 Claims, 3 Drawing Sheets

METHOD OF MAKING MACHINE COMPONENT WITH ALUMINUM ALLOY UNDER TEMPERATURE-LIMITED FORMING CONDITIONS

TECHNICAL FIELD

This patent disclosure relates generally to a method of making a machine component and, more particularly, to a method of making a machine component using an aluminum alloy.

BACKGROUND

Higher pressure ratio and life cycle requirements of machine systems, such as a turbocharger, for example, are placing higher and higher temperature demands upon those components that make up the various machine systems. Alloys that are conventionally suitable for higher temperature capability and higher fatigue strength, such as Ti alloys, for example, are more expensive and heavier than other materials more commonly used for such components, e.g., aluminum. In the case of a turbocharger, using some high-temperature alloys would result in a heavier component which would negatively affect its response rate.

U.S. Pat. No. 8,323,428 is entitled, "High Strain Rate Forming of Dispersion Strengthened Aluminum Alloys." The '428 patent is directed to a dispersion strengthened aluminum base alloy that is shaped into metal parts by high strain rate forging compacts or extruded billets composed thereof. The dispersion strengthened alloy can have the formula $Al_{bal}Fe_aSi_bX_c$, wherein X is at least one element selected from Mn, V, Cr, Mo, W, Nb, and Ta, "a" ranges from 2.0 to 7.5 weight %, "b" ranges from 0.5 to 3.0 weight %, "c" ranges from 0.05 to 3.5 weight %, and the balance is aluminum plus incidental impurities. Alternatively, the dispersion strengthened alloy may be described by the formula $Al_{bal}Fe_aSi_bV_dX_c$, wherein X is at least one element selected from Mn, Mo, W, Cr, Ta, Zr, Ce, Er, Sc, Nd, Yb, and Y, "a" ranges from 2.0 to 7.5 weight %, "b" ranges from 0.5 to 3.0 weight %, "d" ranges from 0.05 to 3.5 weight %, "c" ranges from 0.02 to 1.50 weight %, and the balance is aluminum plus incidental impurities. In both cases, the ratio [Fe+X]:Si in the dispersion strengthened alloys is within the range of from about 2:1 to about 5:1.

It will be appreciated that this background description has been created by the inventors to aid the reader, and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims, and not by the ability of any disclosed feature to solve any specific problem noted herein.

SUMMARY

In embodiments, the present disclosure describes a method of making a machine component. In one embodiment, the method includes extruding a supply of an aluminum alloy to produce an extrusion. The extrusion is formed under temperature-limited forming conditions of 275° C. or less to produce a blank. The blank is machined to at least one predetermined tolerance to produce the machine component.

Further and alternative aspects and features of the disclosed principles will be appreciated from the following detailed description and the accompanying drawings. As will be appreciated, the methods of making a machine component disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Embodiments of methods of making a machine component are described herein. In embodiments, a machine component can be made from an aluminum alloy using any suitable method of making a machine component according to principles of the present disclosure. In embodiments, the machine component can be any suitable component for use in a machine, such as a turbocharger compressor, for example.

Figure 1:
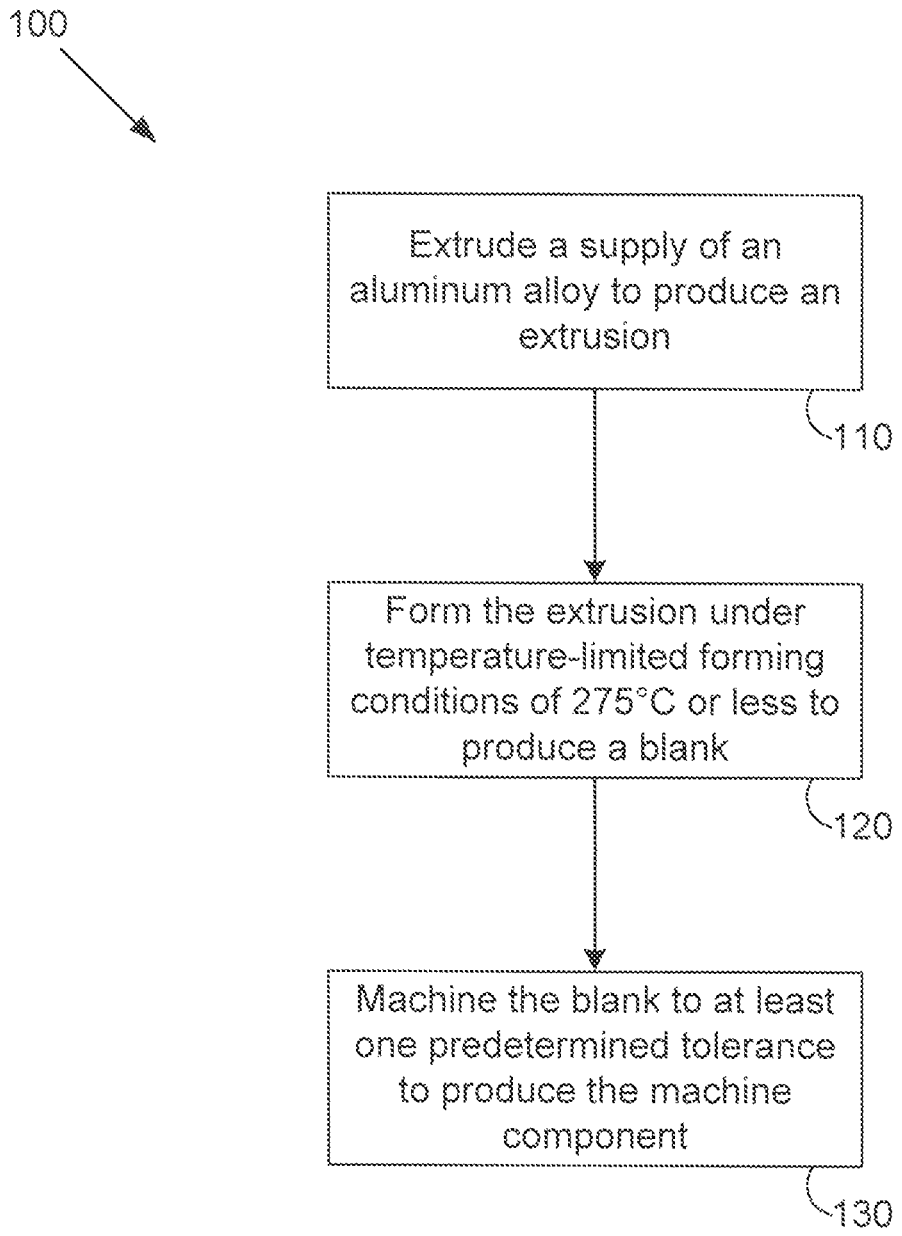
FIG. 1 is a flow chart illustrating steps of an embodiment of a method of making a machine component according to principles of the present disclosure.

Referring to FIG. 1, steps of an embodiment of a method 100 of making a machine component in accordance with principles of the present disclosure are shown. In the method 100, a supply of an aluminum alloy is extruded to produce an extrusion (step 110). The extrusion is formed under temperature-limited forming conditions of 275° C. or less to produce a blank (step 120). The blank is machined to at least one predetermined tolerance to produce the machine component (step 130).

The supply of the aluminum alloy can be made using any suitable technique. In embodiments of a method of making a machine component following principles of the present disclosure, the supply of the aluminum alloy is produced via a rapid solidification process. In embodiments, any suitable rapid solidification process known to those skilled in the art can be used to produce the aluminum alloy. For example, in embodiments, the rapid solidification process used to produce the supply of aluminum alloy comprises melt spinning.

In embodiments, the rapid solidification process used to produce the aluminum alloy includes producing a ribbon of the aluminum alloy. The ribbon of the aluminum alloy can be chopped to form a plurality of flakes. In other embodiments, the flakes are produced directly using any suitable technique known to those skilled in the art. The plurality of flakes is extruded to produce the extrusion.

For example, in embodiments, the technique of melt spinning includes casting molten constituent elements of the aluminum alloy onto a rotating wheel. The wheel is typically made from a highly thermal conductive material, such as copper, to promote rapid heat transfer. The molten material landing on the rotating wheel can solidify in a rapid, near instantaneous, manner. The supply of aluminum alloy is discharged from the rotating wheel in the form of a thin ribbon. This ribbon is then chopped in a cutting mill to form fine flakes (or chips). The consolidation of the flakes of aluminum alloy produced by the melt spinning process can be carried out through the plastic working of the material during the extrusion process.

In embodiments, any suitable extrusion process can be employed to produce the extrusion in step 110. For example, in embodiments, a continuous rotary extrusion process can be used to produce the extrusion in step 110. In a continuous rotary extrusion process, the supply of aluminum alloy can be introduced between a drive wheel and an extrusion deflecting element. The friction force at a material-tool interface advances the supply of the aluminum alloy into a deformation chamber, which is followed by extrusion through a die orifice. Friction also causes gradual heating of the feedstock such that the supply of the aluminum alloy reaches a temperature suitable for the extrusion process to form a consolidated extrusion of the aluminum alloy.

The machine component can be produced from any suitable aluminum alloy following principles of the present disclosure. In embodiments, the aluminum alloy includes aluminum and at least one other element comprising a strengthening metal. In embodiments, the aluminum alloy includes aluminum and at least one other element providing thermal expansion control. In embodiments, a commercially-available aluminum alloy can be used to produce the machine component. For example, in embodiments, aluminum alloys commercially-available from RSP Technology of The Netherlands that have been produced using a rapid solidification process (such as those under the trade names AA8009 alloy, RSA8009 alloy, AA4019 alloy, and RSA4019 alloy) can be used in a method of making a machine component following principles of the present disclosure.

In embodiments, the aluminum alloy used to produce the machine component comprises an aluminum alloy that is primarily strengthened by precipitation from super saturation of one or more transition metals, e.g. Ti, V, Cr, Mn, Fe, Ni, Zr, etc. Such an aluminum alloy is preferably made via a rapid solidification process, such as melt spinning, and may not be able to be otherwise made using a traditional ingot metallurgy process because the alloying elements have low solubility.

In embodiments, the aluminum alloy includes aluminum and up to 3.5 percent by weight of at least one element of a first group of elements which consists of Si, Sc, Ti, V, Cr, Mn, Fe, Ni, Cu, Y, Zr, Mo, Ce, Nd, Er, Yb, Ta, and W. In at least some of those embodiments, the aluminum alloy can include at least one element of a second group of elements. And in still other embodiments, the aluminum alloy can include at least one element of a third group of elements.

For example, in embodiments using a first formulation, the aluminum alloy includes up to 3.5 percent by weight of at least one element of the first group of elements and between 3.5 percent and 9 percent by weight of at least one element of a second group of elements which consists of Ti and V. In at least some of those embodiments, the aluminum alloy also includes between 3.5 percent and 8.5 percent by weight of at least one element of a third group of elements which consists of Si, Cr, Mn, Fe, and Ni. In at least some of those embodiments of the first formulation, the aluminum alloy includes one or more of the first, second, and third groups of elements, and the balance is aluminum (but may also include impurities).

Exemplary embodiments of an aluminum alloy using the first formulation that are suitable for use in a method of making a machine component following principles of the present disclosure fall within the composition descriptions (expressed as weight percentage) as set forth below in Table I:

TABLE I

Exemplary Embodiments of Aluminum Alloy (Formula 1) According to Present Disclosure

| Embodiment | AL | X | Y | Z |
|---|---|---|---|---|
| 1 | balance | — | — | 0-3.5 wt % |
| 2 | balance | 3.5-9.0 wt % | — | 0-3.5 wt % |
| 3 | balance | 3.5-9.0 wt % | 3.5-8.5 wt % | 0-3.5 wt % |

where X is at least one element from Ti and V;
Y is at least one element from Si, Cr, Mn, Fe, and Ni; and
Z is at least one element from Si, Sc, Ti, V, Cr, Mn, Fe, Ni, Cu, Y, Zr, Mo, Ce, Nd, Er, Yb, Ta, and W.

In other embodiments using a second formulation, the aluminum alloy includes up to 3.5 percent by weight of at least one element of the first group of elements and between 3.5 percent and 15 percent by weight of at least one element of a second group of elements which consists of Cr, Mn, and Fe. In at least some of those embodiments, the aluminum alloy also includes between 3.5 percent and 12 percent by weight of at least one element of a third group of elements which consists of Si, Ni, and Cu. In at least some of those embodiments of the second formulation, the aluminum alloy includes one or more of the first, second, and third groups of elements, and the balance is aluminum (but may also include impurities).

Exemplary embodiments of an aluminum alloy using the second formulation that are suitable for use in a method of making a machine component following principles of the present disclosure fall within the composition descriptions (expressed as weight percentage) as set forth below in Table II:

TABLE II

Exemplary Embodiments of Aluminum Alloy (Formula 2) According to Present Disclosure

| Embodiment | AL | X' | Y' | Z |
|---|---|---|---|---|
| 4 | balance | 3.5-15 wt % | | 0-3.5 wt % |
| 5 | balance | 3.5-15 wt % | 3.5-12 wt % | 0-3.5 wt % |

where X' is at least one element from Cr, Mn, and Fe;
Y' is at least one element from Si, Ni, and Cu; and
Z is at least one element from Si, Sc, Ti, V, Cr, Mn, Fe, Ni, Cu, Y, Zr, Mo, Ce, Nd, Er, Yb, Ta, and W.

In other embodiments using a third formulation, the aluminum alloy includes up to 3.5 percent by weight of at least one element of the first group of elements and between 3.5 percent and 40 percent by weight of at least one element of a second group of elements which consists of Mg, Si, and Cu. In at least some of those embodiments, the aluminum alloy also includes between 3.5 percent and 15 percent by weight of at least one element of a third group of elements which consists of Cr, Mn, Fe, and Ni. In at least some of those embodiments of the third formulation, the aluminum alloy includes one or more of the first, second, and third groups of elements, and the balance is aluminum (but may also include impurities).

Exemplary embodiments of an aluminum alloy using the third formulation that are suitable for use in a method of making a machine component following principles of the present disclosure fall within the composition descriptions (expressed as weight percentage) as set forth below in Table III:

TABLE III

Exemplary Embodiments of Aluminum Alloy (Formula 3) According to Present Disclosure

| Embodiment | AL | X" | Y" | Z |
|---|---|---|---|---|
| 6 | balance | 3.5-40 wt % | | 0-3.5 wt % |
| 7 | balance | 3.5-40 wt % | 3.5-15 wt % | 0-3.5 wt % |

where X" is at least one element from Mg, Si, and Cu; Y" is at least one element from Cr, Mn, Fe, and Ni; and Z is at least one element from Si, Sc, Ti, V, Cr, Mn, Fe, Ni, Cu, Y, Zr, Mo, Ce, Nd, Er, Yb, Ta, and W.

Exemplary aluminum alloys suitable for use in embodiments of a method of making a machine component following principles of the present disclosure include, but are not limited to, those that have compositions (the subscript expressing the weight percentage of the given element) as set forth below in Table IV:

TABLE IV

Exemplary Aluminum Alloys Suitable for Use in a Method According to Present Disclosure (Weight %)

| |
|---|
| $Al_{bal}$—$Mg_{13.5}$—$Si_7$—$Cu_2$ |
| $Al_{bal}$—$Si_{20}$—$Fe_5$—$Ni_2$ |
| $Al_{bal}$—$Si_{21}$—$Cu_4$—$Mg_{1.2}$—$Fe_{2.5}$—$Ni_{1.5}$ |
| $Al_{bal}$—$Si_{30}$—$Cu_{1.5}$—$Mg_{1.2}$—$Fe_{0.4}$—$Ni_{0.4}$ |
| $Al_{bal}$—$Ti_3$—$Zr_2$ |
| $Al_{bal}$—$Ti_5$—$Fe_2$ |
| $Al_{bal}$—$Cr_5$—$Zr_2$—$Mn_1$ |
| $Al_{bal}$—$Cr_{6.0}$—$Fe_{2.3}$—$Ti_{0.4}$—$Si_{0.7}$ |
| $Al_{bal}$—$Mn_{12}$—$Cu_{4.5}$—$Zn_{2.5}$—$Fe_{0.2}$ |
| $Al_{bal}$—$Fe_{5.8}$—$Ti_{3.2}$ |
| $Al_{bal}$—$Fe_{11.4}$—$Si_{1.77}$—$V_{1.63}$—$Mn_{0.9}$ |
| $Al_{bal}$—$Ni_5$—$Fe_{2.5}$—$Mn_1$—$Mo_{0.8}$—$Zr_{0.8}$ |

One skilled in the art will appreciate that the aluminum balance of the exemplary aluminum alloys listed above can also include acceptable impurities, such as are found in commercially-available supplies of aluminum alloys. Similarly, it should be understood that the percent weight values for the components of various embodiments of an aluminum alloy for use in a method following principles of the present disclosure are expressed as nominal values. It is contemplated that suitable tolerance variations are also included within the described nominal values, as will be appreciated by one skilled in the art. In yet other embodiments, any aluminum alloy following principles of the present disclosure can be used to produce the machine component.

In embodiments, the extrusion can be further processed before being formed in step 120. For example, in embodiments, the extrusion is cut into a segment prior to being formed in step 120. The segment of the extrusion is then formed to produce the blank in step 120.

In embodiments, any suitable technique can be used to form the extrusion in step 120. In embodiments, the extrusion is formed using cold working techniques known to those skilled in the art. In embodiments where the machine component is made from an aluminum alloy produced via a rapid solidification process, the extremely-high homogeneous microstructure of the aluminum alloy as a result of its being made using a rapid solidification process can enhance its cold workability.

In embodiments, the extrusion is formed in step 120 under temperature-limited conditions that do not exceed 275° C. In embodiments, the extrusion is formed in step 120 under temperature-limited conditions so that the temperature at which precipitates in the aluminum alloy used to produce the extrusion start to lose their most effective strengthening effect is not reached. In embodiments, this limiting temperature can be the temperature at which the coherency between the precipitates crystal structure and the alloy matrix crystal structure is lost or the precipitates coarsen significantly such that performance capability is decreased.

Figure 2:
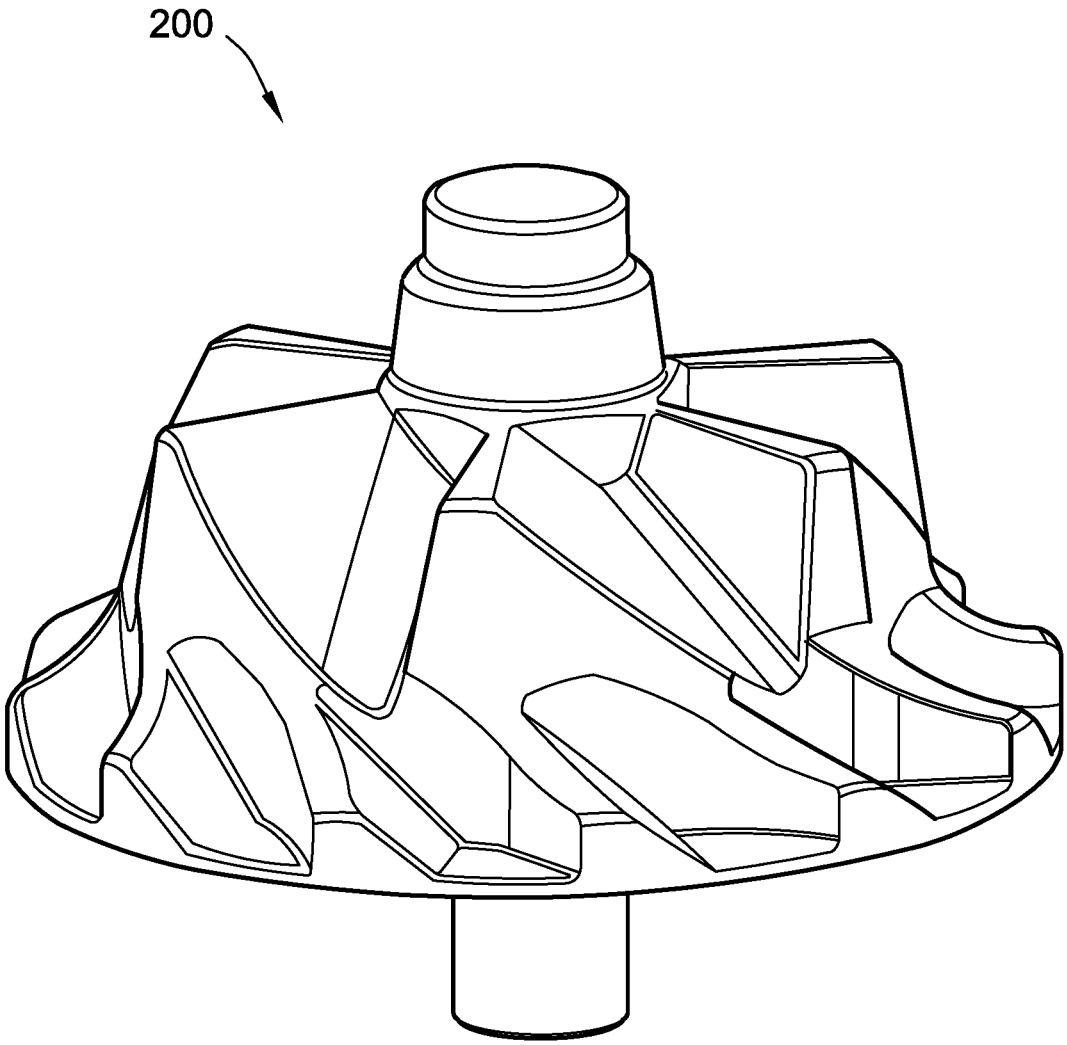
FIG. 2 is a side view of an embodiment of a blank having a near net shape and produced using a method of making a machine component following principles of the present disclosure.
Figure 3:
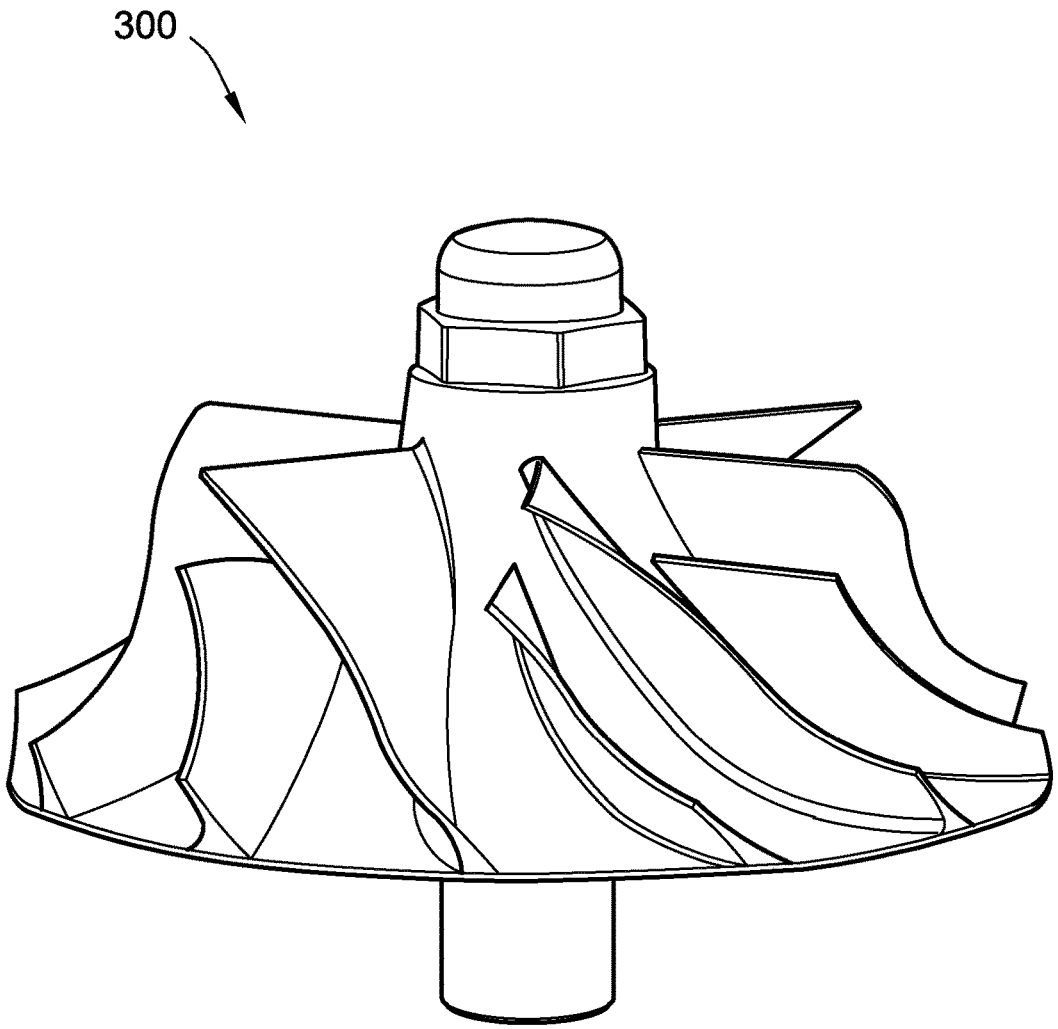
FIG. 3 is a side view of a machine component in the form of a turbocharger compressor produced from the blank of FIG. 2 after it has been machined to final dimension to produce the machine component using a method of making following principles of the present disclosure.

In embodiments, forming the extrusion in step 120 comprises forming the extrusion such that the blank has a near net shape. For example, referring to FIG. 2, an embodiment of a compressor blank 200 is shown that has a near net shape. In embodiments, the extrusion can be form in step 120 to produce the blank 200 such that it has a volume that is no more than one hundred fifty percent of the volume of the final machined component 300, as shown in FIG. 3. In embodiments, the extrusion can be form in step 120 to produce the blank 200 such that it has a volume that is no more than one hundred twenty percent of the volume of the final machined component 300.

In embodiments, forming the extrusion in step 120 includes cold working the extrusion by one or both of cold heading and cold extruding, e.g., in the case of small and middle size machine components. For larger machine components, forming the extrusion in step 120 can include cold rolling processes to bring the wrought extrusion into a near net shape blank, for example. Cold working the extrusion in step 120 can also provide additional operation cost saving compared to hot forming the extrusion and can enhance room temperature mechanical strength through work hardening.

In embodiments, forming the extrusion in step 120 includes using a squeeze-type press to produce the blank. Using a squeeze-type press can help maintain a more uniform stroke rather than using an impact type press. For example, in embodiments, a mechanical press may be utilized for small and middle size machine components up to about 160 mm diameter beyond which a hydraulic press can be used. In embodiments, forming the extrusion in step 120 can be performed without using an impact press (e.g., a steam hammer) which can help prolong tooling life.

In embodiments of a method of making a machine component following principles of the present disclosure, the extrusion can be formed in step 120 using so-called "warm" forging techniques. In embodiments, the cold work processing in step 120 can be assisted with limited heating to help facilitate the cold work process and to lower the press tonnage capacity requirements. The heating can be limited to be below the intended application temperature of the machine component.

For example, in embodiments, forming the extrusion can include heating the extrusion during forming such that temperature-limited forming conditions of 275° C. or less are maintained. In such embodiments, any suitable heating source can be used. For example, in embodiments, the extrusion is heated using induction heating as part of step 120.

In embodiments using an aluminum alloy with a high silicon content for thermal expansion control (e.g. when the machine component is one for a piston application), such as, the RSA4019 alloy from RSP Technology of The Netherlands, assisted heating in step 120 can be used to enhance the ductility of the aluminum alloy to avoid cracking the extrusion during forming. The temperature in such assisted heating can be selected to control the heat exposure while still providing sufficient ductility for forming (and can be limited to 275° C. or less).

In embodiments of a method of making a machine component following principles of the present disclosure, the process can take advantage of the heat imparted within the extrusion as a result of its undergoing the extrusion process in step 110. For example, in embodiments, forming the extrusion in step 120 occurs within a predetermined time period after the extrusion is extruded in step 110 such that the extrusion has a temperature that is greater than an ambient temperature when it is formed. In embodiments, forming the extrusion in step 120 occurs within a predetermined time period after the extrusion is extruded in step 110 such that the extrusion is not in thermal equilibrium when it is formed in step 120.

For example, in embodiments, after the supply of the aluminum alloy is extruded at wrought bar manufacturing, and while it is still hot from the extrusion process, it can be cut and warm worked into a blank that has a near net shape. In this way, the heat input beyond application temperature 275° C. can be avoided to help maintain the performance properties of the aluminum alloy. Thus, the benefit of assisted heating can be attained without the aluminum alloy incurring additional heat damage.

In embodiments of a method of making a machine component following principles of the present disclosure, after forming the extrusion to produce the blank in step 120 and before machining the blank in step 130, the blank can be subjected to stress relieving to reduce residual stress within the blank. In embodiments, any suitable stress relieving technique can be used to reduce the residual stress in the blank. In embodiments, the stress relieving process occurs using temperature-limited conditions such that the temperature does not exceed a limit temperature corresponding to a maximum application temperature for which the machine component is intended to withstand and/or experience in its intended use.

In step 130, the blank can be machined using any suitable technique to produce the machine component. For example, a lathe can be used for lathe-turning operations and/or a grinder for grinding operations, for example. The blank can be machined such that one or more dimensional characteristics is within a predetermined tolerance. The blank can be machined such that one or more surfaces possesses a roughness within a predetermined tolerance. In embodiments, lapping, polishing, and/or cleaning operations (using any suitable technique as will be appreciated by one skilled in the art) can also be performed as part of the final machining of the machine components to ready it for installation.

For example, referring to FIG. 3, the compressor blank 200 has been machined in step 130 from its near net shape to produce a compressor 300 suitable for use in a turbocharger system of an engine of a machine. It should be understood that in other embodiments, a method of making a machine component following principles of the present disclosure can be used to produce different compressors and/or different machine components (e.g., one or more components of a piston assembly), as will be appreciated by one skilled in the art.

INDUSTRIAL APPLICABILITY

The industrial applicability of the embodiments of a method of making a machine component described herein will be readily appreciated from the foregoing discussion. The described principles are applicable to a variety of machines in which a machine component is subjected to high-temperature conditions. Examples of such machines include those machines that include a compressor, such as a compressor for a turbocharger of an engine, for example. Machine components made using a method following principles of the present disclosure can advantageously be offered on new equipment, or can be used to retrofit existing equipment operating in the field.

In embodiments of a method of making a machine component following principles of the present disclosure, a high temperature aluminum alloy (balance Al, one or more elements such as Fe as major strengthening elements, and other elements such as Si for thermal expansion control) can be used to make a machine component subject to high temperatures (such as turbine blades for turbochargers). The method can include forming an extrusion under temperature-limited conditions at or below 275° C. to form the extrusion into a blank having a near net shape.

In embodiments of a method of making a machine component following principles of the present disclosure, a supply of an aluminum alloy can be used to produce the machine component which has been made using a rapid solidification process. In such embodiments, it is possible to control structure parameters like the size of the particles, the size of the precipitates, etc. in the aluminum alloy. Additionally, the production of the supply of the aluminum alloy by rapid solidification allows introducing alloying constituents that are incompatible with the state of equilibrium. For example, such an aluminum alloy can have a fine-grained structure with a characteristic network of nanometer-size precipitates inside the grains.

Forming the extrusion into the blank under temperature-limited conditions can help preserve alloy properties that are possible as a result of the rapid solidification process that would otherwise be impaired if hot forming were used. In addition, cold (or warm) working the extrusion to a near net shape blank can help reduce material consumption as well as machining time to achieve cost savings. For example, in the case of a turbocharger compressor, machining from a near net shape blank (such as is shown in FIG. 2) can reduce material consumption by up to about four times as compared to machining directly from a bar-shaped extrusion. In addition, the cold-forming technique can produce a surface finish that is acceptable for use without additional machining steps in at least some areas of the machine component, such as, the back disc and nose of a turbocharger compressor, for example.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for the features of interest, but not to exclude such from the scope of the disclosure entirely unless otherwise specifically indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A method of making a machine component, the method comprising:

extruding a supply of an aluminum alloy to produce an extrusion;

forming the extrusion under temperature-limited forming conditions of 275° C. or less to produce a blank;

machining the blank to at least one predetermined tolerance to produce the machine component.

2. The method of claim 1, further comprising:

producing the supply of the aluminum alloy via a rapid solidification process.

3. The method of claim 2, wherein the rapid solidification process comprises melt spinning.

4. The method of claim 2, wherein the rapid solidification process includes producing a ribbon of the aluminum alloy and chopping the ribbon of the aluminum alloy to form a plurality of flakes, and wherein the plurality of flakes is extruded to produce the extrusion.

5. The method of claim 1, wherein the aluminum alloy includes aluminum and at least one strengthening metal.

6. The method of claim 1, wherein the aluminum alloy includes aluminum and up to 3.5 percent by weight of at least one element of a first group of elements, the first group of elements consisting of Si, Sc, Ti, V, Cr, Mn, Fe, Ni, Cu, Y, Zr, Mo, Ce, Nd, Er, Yb, Ta, W.

7. The method of claim 6, wherein the aluminum alloy includes between 3.5 percent and 9 percent by weight of at least one element of a second group of elements, the second group of elements consisting of Ti and V.

8. The method of claim 7, wherein the aluminum alloy includes between 3.5 percent and 8.5 percent by weight of at least one element of a third group of elements, the third group of elements consisting of Si, Cr, Mn, Fe, and Ni.

9. The method of claim 6, wherein the aluminum alloy includes between 3.5 percent and 15 percent by weight of at least one element of a fourth group of elements, the fourth group of elements consisting of Cr, Mn, and Fe.

10. The method of claim 9, wherein the aluminum alloy includes between 3.5 percent and 12 percent by weight of at least one element of a fifth group of elements, the fifth group of elements consisting of Si, Ni, and Cu.

11. The method of claim 6, wherein the aluminum alloy includes between 3.5 percent and 40 percent by weight of at least one element of a sixth group of elements, the sixth group of elements consisting of Mg, Si, and Cu.

12. The method of claim 11, wherein the aluminum alloy includes between 3.5 percent and 15 percent by weight of at least one element of a seventh group of elements, the seventh group of elements consisting of Cr, Mn, Fe, and Ni.

13. The method of claim 1, further comprising:

cutting, prior to forming, the extrusion into a segment, and then forming the segment to produce the blank.

14. The method of claim 1, wherein forming the extrusion comprises forming the extrusion such that the blank has a near net shape.

15. The method of claim 1, wherein forming the extrusion includes using a squeeze-type press to produce the blank.

16. The method of claim 1, wherein forming the extrusion includes heating the extrusion during forming such that temperature-limited forming conditions of 275° C. or less are maintained.

17. The method of claim 16, wherein the extrusion is heated using induction heating.

18. The method of claim 1, wherein forming the extrusion occurs within a predetermined time period after the extrusion is extruded such that the extrusion has a temperature that is greater than an ambient temperature when it is formed.

19. The method of claim 1, wherein forming the extrusion occurs within a predetermined time period after the extrusion is extruded such that the extrusion is not in thermal equilibrium when it is formed.

20. The method of claim 1, further comprising:

after forming the extrusion to produce the blank and before machining the blank, stress relieving the blank to reduce residual stress within the blank.

* * * * *